US012435509B2

(12) United States Patent
Hooper

(10) Patent No.: US 12,435,509 B2
(45) Date of Patent: Oct. 7, 2025

(54) FRAME AND INSULATION PANEL SYSTEM

(71) Applicant: Insu-Built Structures Inc., Abbotsford (CA)

(72) Inventor: Lawrie Hooper, Abbotsford (CA)

(73) Assignee: Insu-Built Structures Inc., Abbotsford (CA)

( * ) Notice: Subject to any disclaimer, the term of this patent is extended or adjusted under 35 U.S.C. 154(b) by 156 days.

(21) Appl. No.: 17/814,912

(22) Filed: Jul. 26, 2022

(65) Prior Publication Data

US 2023/0055360 A1 Feb. 23, 2023

(30) Foreign Application Priority Data

Jul. 26, 2021 (CA) ..... CA 3126079
Mar. 11, 2022 (CA) ..... CA 3151764

(51) Int. Cl.

| | |
|---|---|
| ***E04B 2/86*** | (2006.01) |
| ***E04G 11/18*** | (2006.01) |
| ***E04G 17/04*** | (2006.01) |
| ***E04G 17/06*** | (2006.01) |

(52) U.S. Cl.

CPC ..... *E04B 2/8652* (2013.01); *E04G 17/06* (2013.01); *E04B 2/8635* (2013.01); *E04B 2103/02* (2013.01); *E04G 11/18* (2013.01); *E04G 17/047* (2013.01); *E04G 2017/0646* (2013.01)

(58) Field of Classification Search

CPC .. E04B 2/8652; E04B 2103/02; E04B 2/8635; E04G 17/06; E04G 2017/0646; E04G 17/047; E04G 11/18

See application file for complete search history.

(56) References Cited

U.S. PATENT DOCUMENTS

| | | | | |
|---|---|---|---|---|
| 1,293,391 | A * | 2/1919 | Ewing | E04G 17/0721 29/897.34 |
| 3,420,491 | A * | 1/1969 | Gilbert | E04G 17/06 249/63 |
| 6,698,710 | B1 * | 3/2004 | VanderWerf | E04B 2/8652 52/294 |
| 7,870,702 | B2 * | 1/2011 | McKay | E04C 5/20 52/681 |
| 7,908,809 | B2 * | 3/2011 | Meier | E04F 21/05 52/319 |
| 2011/0057090 | A1 * | 3/2011 | Spude | E04G 11/06 249/19 |
| 2016/0281355 | A1 * | 9/2016 | McDonagh | E04G 17/14 |
| 2020/0040581 | A1 * | 2/2020 | Paulger | E04C 5/168 |

* cited by examiner

*Primary Examiner* — Omar F Hijaz
(74) *Attorney, Agent, or Firm* — Stoel Rives

(57) ABSTRACT

A modular form system for constructing insulated concrete walls comprises spaced apart vertical frame members which include retention structures allowing for the insertion of spaced-apart rows of insulated panels to form an internal cavity into which concrete may be poured. The retention structures may include flanges on the periphery of the frame members and plates positionable in opposition to the flanges. The insulated panels are retained between the flanges and the plates.

6 Claims, 15 Drawing Sheets

FRAME AND INSULATION PANEL SYSTEM

FIELD OF THE INVENTION

This invention relates to building construction. In particular, this invention relates to improvements to insulated concrete forms for building wall construction.

BACKGROUND OF THE INVENTION

A popular material for construction of low-rise buildings, and becoming increasingly popular for residential construction, is concrete. Particularly in larger and taller buildings constructed from concrete, the concrete must incorporate a skeleton of reinforcing bar or "rebar" to resist the tensile and bending forces developed in the wall. The individual horizontal and vertical rebar must be assembled so that they are correctly distributed in the concrete form and retain that form while the concrete is poured around the rebar and solidifies. Conventionally, this is done through rebar-tying, that is, tying adjacent perpendicular rebar together with wire. Rebar-tying is an extremely time consuming and labour-intensive process. It would be advantageous if a modular positioning system for a wall's rebar skeleton could be provided so as to obviate the need for tying.

In a concrete building, the concrete is generally supplied as a slurry which is poured into forms and allowed to solidify. While the forms are often reusable, there is a considerable amount of time and labour expended to erect and remove the forms before and after the concrete is poured. It would be far more efficient if the forms could be left in place, and preferably comprised components necessary to the completed wall, such as insulation.

Insulated concrete form (ICF) wall systems wherein the forms comprise part of the completed wall are known. However, such systems often use highly specific and customized components, including the insulation panels. It would be advantageous if the ICF wall system could use at least some generic and widely available components.

ICF wall systems can comprise two main components: spaced apart rows of insulating panels, and form members that retain the rows of insulating panels apart from each other to form a cavity or channel into which the concrete is poured. Insulating panels are commonly available in different thicknesses. It would be advantageous if the insulated concrete form were modular to allow a single form member shape to be used with different thicknesses of insulating panels. Additionally, or in the alternative, it would be advantageous if the thicker insulation panels included features that allowed it to be used with an insulated concrete form member intended for use with a thinner insulation panel.

After construction of a wall's substructure is complete, a weather barrier must be applied on the exterior surface of the wall before the exterior cladding may be installed. Weather barriers generally comprise a sheet of material, often a polymer, that resists bulk fluid infiltration of the wall but allows vapour to be released from the wall. For optimal performance, the weather barrier should be continuous and unbroken across the exterior of the wall substructure.

Commonly, a weather barrier is supplied as a roll of material that is wrapped around the exterior of the wall substructure. This is also a time-consuming and labor-intensive process in building construction.

Additionally, exterior cladding cannot be affixed directly to the weather barrier; most building codes require an air gap between the cladding and the weather barrier so that bulk fluid that manages to infiltrate the cladding may drain to the ground instead of being trapped against the weather barrier. Commonly, flashing strips are fastened to the weather barrier by nails or screws, and the cladding is then affixed to the flashing strips. The process of applying the flashing strips is also very time-consuming and labour-intensive. Further, the flashing fasteners perforate the weather barrier and allow bulk fluid to infiltrate the weather barrier. It would be advantageous to provide for a method of affixing exterior cladding in a manner that does not necessitate additional labour or compromise the weather barrier.

Insulated concrete form systems have a fixed height. Accordingly, when constructing walls taller than this fixed height, multiple layers of insulated concrete forms must be used. Existing insulated concrete form systems generally require specialized components to attach an upper layer of insulated concrete forms to the lower layer. It would be advantageous if a minimal number of different types of components could be used in constructing taller walls.

It is therefore an object of this invention to provide a modular positioning system for a wall's internal rebar skeleton.

It is a further object of the invention to provide an ICF system that incorporates an exterior weather barrier.

It is another further object of the invention to provide an ICF system that allows exterior cladding to be applied in a manner that creates an air gap dictated by building codes while also avoiding compromising the underlying weather barrier.

It is still another further object of the invention to provide an ICF system that can be used in the construction of taller walls without the need for specialized components between vertical layers of forms.

It is yet another further object of the invention to provide an ICF system that is modular to account for insulation panels of differing thicknesses.

These and other objects will be better understood by reference to this application as a whole. Not all of the objects are necessarily met by all embodiments of the invention described below or by the invention defined by each of the claims.

SUMMARY OF THE INVENTION

In one aspect, the invention comprises a rebar trestle system for positioning horizontal and vertical rebar making up the internal skeleton of a concrete wall. The rebar trestle system comprises a plurality of longitudinally (that is, in the direction of the wall to be constructed) spaced apart vertical frame members. Each frame member comprises an interior post, an exterior post, and a plurality of substantially horizontal trays extending transversely between the interior post and exterior post. Each tray comprises a plurality of slots formed in an upper edge of the tray. Each tray further comprises a plurality of apertures formed through the tray. Preferably, there will be three slots and two apertures in each tray, although these numbers will vary depending upon the size, strength and durability of the desired finished wall. The rebar trestle system preferably further comprises a plurality of rebar retaining members, each rebar retaining member itself retained by one of the apertures. Each rebar retaining member preferably comprises an elastically deformable split pin insertable into an aperture, a rebar receiving portion, and an arm extending between the split pin and the rebar receiving portion. The split pin securely snap fits with the aperture. Horizontal rebar may be laid into collinear slots of longitudinally adjacent trays and vertical rebar may be threaded through vertically adjacent rebar receiving portions, thereby providing a correctly-positioned rebar skeleton prior to pouring concrete to finish the wall. The rebar trestle system will form part of the finished wall after pouring.

In another aspect, the invention comprises an improved ICF system for construction of cast-in-place concrete walls, wherein the forms remain in place after casting as a component of the finished wall. The ICF system comprises a plurality of longitudinally spaced-apart vertical form members. Each form member comprises an inner post, an outer post, and a plurality of vertically spaced-apart transverse interstitial webs connecting the inner post to the outer post.

At least some of the interstitial webs of each of the form members further comprise one or more troughs formed in an upper edge of the interstitial web. Rebar may then be laid horizontally in the troughs of interstitial webs of adjacent frame members to provide additional strength. At least the uppermost and lowermost interstitial webs preferably each comprise a plurality of ports formed longitudinally through the interstitial web. The ICF system then preferably further comprises a plurality of rebar retainers, each rebar retainer inserted into a port. Vertical rebar can be threaded through receiving portions (such as rings) of vertically adjacent rebar retainers, thereby holding the vertical rebar upright and in position in the interstitial cavity. The troughs and rebar retainers support a grid of rebar that forms a skeleton for the concrete once cast, giving additional strength and durability to the wall.

The inner and outer posts both each comprise an inner flange, an outer flange, and a post web connecting the inner flange to the outer flange. The inner flange, outer flange, and post web together define two adjacent vertical channels that open in longitudinally opposite directions. The ICF system further comprises a plurality of inner panels that each insert into the channels of adjacent inner posts and extend longitudinally between adjacent form members, and a plurality of outer posts that likewise each insert into channels of adjacent outer posts and extend longitudinally between adjacent form members. The form members thus transversely space apart the resultant rows of inner panels and outer panels to create an interstitial cavity that is filled with concrete to construct the wall. The panels will preferably comprise an insulating material to improve the thermal efficiency of the wall.

In another aspect, the plurality of outer panels each further comprise a weather resistant membrane, such as TYVEK HOMEWRAP®, applied to the outer surface of each outer panel. A plurality of sheathes are provided, each sheath sliding over the exterior flange of an outer stud. The sheathes may be produced in a variety of thicknesses, such that the combined thickness of each sheath and exterior flange is preferably equivalent to the air gap distance mandated by the applicable building codes for the jurisdiction in which the invention is deployed. Exterior cladding may then be fixed directly to the sheath and flange for completion of the building without compromising the weather resistant membranes.

In another aspect, the components of the invention can be used to construct multiple-layer walls without the need for additional components. After constructing a base layer of wall, the inner and outer insulating panels may protrude above the top of the form members of the base layer. Additional form members are then laid horizontally along the top of the base layer wall such that the protruding insulation panels insert into the downward-facing channels of the horizontally laid form members. A second layer of insulating panels alternating with vertical form members may be inserted into the upward-facing channels of the horizontally laid form members to create an insulated concrete form for the next vertical section of wall.

In another aspect, the invention comprises a modular insulated concrete form system comprising a plurality of modular form members, one or more first panels, and one or more second panels. Each spacing form member comprises a first post, a second post, and one or more post connecting members connecting the first post to the second post. The first post comprises a first flange and a first web. The second post comprises a second flange and a second web. The post connecting members connect the first web to the second web. The second form member further comprises one or more first panel retaining members that each attach to one of the one or more post connecting members proximate to the first web. The spacing form member also further comprises one or more second panel retaining members that each attach to one of the one or more post connecting members proximate to the second web. Preferably, each post connecting member comprises at least one first slot into which the first panel retaining member inserts and at least one second slot into which the second panel retaining member inserts. The second panels are retained between the second flanges and second panel retaining members of adjacent spacing form members. The first panels are retained between the first flanges and first panel retaining members of adjacent spacing form members. Fasteners may be used to attach the first panel retaining members and second panel retaining members to the first panels and second panels, respectively. The post connecting members may further comprise the troughs for receiving horizontal reinforcing bar. The post connecting members may further comprise the apertures for receiving rebar retaining members, which in turn receive vertical reinforcing bar.

According to another aspect, the invention is a modular concrete form system for constructing a wall. The modular concrete form system comprises a plurality of modular form members spaced along a perimeter of the wall to be constructed. Each of the modular form members comprises: a first post, the first post comprising a first flange and a first web, a second post, the second post comprising a second flange and a second web, a plurality of post connecting members extending between the first web and the second web, a plurality of first panel retaining members, each of the first panel retaining members selectively seatable on one of the post connecting members in proximity to the first web, and a plurality of second panel retaining members, each of the second panel retaining members selectively seatable on one of the post connecting members in proximity to the second web. Each of one or more first insulating panels are retained between respective first flanges and first panel retaining members of adjacent spacing form members. Each of one or more second insulating panels are retained between respective second flanges and second panel retaining members of adjacent spacing form members.

In a further aspect, each of the one or more post connecting members comprises: a plurality of first slots spaced at predetermined distances from the first web, wherein a respective first panel retaining member associated with the post connecting member may be selectively seated in one of the first slots to accommodate a first panel having a predetermined thickness; and a plurality of second slots spaced at predetermined distances from the second web, wherein a respective second panel retaining member associated with the post connecting member may be selectively seated in one of the second slots to accommodate a second panel having a predetermined thickness. The plurality of first slots may comprise two first slots and when the respective first panel retaining members are selectively seated in one of the first slots of each of the one or more post connecting members, the modular concrete form system is configured to accommodate the first panels having a first thickness. When the respective first panel retaining members are selectively seated in the other first slot of each of the one or more post connecting members, the modular concrete form system is configured to accommodate the first panels having a second thickness. The plurality of second slots may comprise two second slots. When the respective second panel retaining members are selectively seated in one of the second slots of each of the one or more post connecting members, the modular concrete form system is configured to accommodate the second panels having the first thickness. When the respective second panel retaining members are selectively seated in the other second slot of each of the one or more post connecting members, the modular concrete form system is configured to accommodate the second insulating panels having the second thickness.

In a further aspect, each of the first panel retaining members and the second panel retaining members are rectangular plates. Each of the first panel retaining members and the second panel retaining members may comprise one or more openings adapted to receive a fastener for securing the first panel retaining member or the second panel retaining member to one of the first insulating panels or the second insulating panels, respectively.

In a further aspect, the first insulating panels comprise cut-outs in edges of the first insulating panel abutting the first webs, the cut-outs configured to surround, at least in part, the first flanges.

In a further aspect, the second insulating panels comprise cut-outs in edges of the second insulating panel abutting the second webs, the cut-outs configured to surround, at least in part, the second flanges.

In a further aspect, each of the post connecting members comprises an upper surface and one or more troughs formed in the upper surface, each of the one or more troughs adapted to receive a horizontal reinforcing bar.

In a further aspect, each of the post connecting members comprises one or more apertures each adapted to receive a rebar retaining member, and wherein the rebar retaining member is adapted to receive a vertical reinforcing bar. Each of the rebar retaining members may comprise a retention clip insertable into the aperture, an arm, and a rebar receiving portion. The rebar receiving portion may comprise an elastically deformable incomplete ring, wherein a gap in the incomplete ring is less than a diameter of the vertical reinforcing bar.

In a further aspect, the first panels and the second panels define, at least in part, an interstitial cavity. When a wall is constructed, the interstitial cavity is at least partially filled with concrete.

According to another aspect, the invention is a method of constructing an insulated concrete wall. The method comprises: providing a modular concrete form system comprising: a plurality of form members, each of the spacing form members comprising: a first post, the first post comprising a first flange and a first web; a second post, the second post comprising a second flange and a second web; one or more post connecting members extending between the first post and the second post, each of the post connecting members comprising: an upper surface; a plurality of slots formed in the upper surface; a plurality of first panel retaining members; a plurality of second panel retaining members; a plurality of insulating first panels having a first thickness; and a plurality of insulating second panels having a second thickness; erecting the spacing form members vertically and spaced along a perimeter of the wall to be constructed; for each of the post connecting members of each of the spacing form members: seating one of the first panel retaining members in one slot spaced at a predetermined distance from the first flange corresponding to the first thickness; and seating one of the panel retaining members in one slot spaced at a predetermined distance from the second flange corresponding to the second thickness; inserting each of the first panels between first flanges and first panel retaining members of adjacent form members; inserting each of the second panels between second flanges and second panel retaining members of adjacent form members; and pouring concrete into an interstitial cavity defined at least in part by the plurality of first panels and the plurality of second panels.

According to another aspect, the invention is a modular form system for constructing an insulated wall. The modular form system comprises: a plurality of modular form members spaced along a perimeter of the wall to be constructed, each of the modular form members comprising: a vertical first post and a vertical second post, each of the first and second posts having a longitudinal axis extending in the vertical direction and comprising: a web extending along the longitudinal axis; a first abutment surface extending from the web parallel to the perimeter; a second abutment surface extending from the web parallel to the perimeter and wherein the first abutment surface and the second abutment surface are opposed across a plane transverse to the perimeter; wherein the first and second abutment surfaces of the first post and the first and second abutment surfaces of the second post are opposed across the perimeter; a plurality of post connecting members extending between the first post and the second post; a plurality of first panel retaining members, each of the first panel retaining members selectively seatable on ones of the post connecting members to accommodate a first panel of insulation between the first or second abutment surface of the first post on a side of the first panel and the first panel retaining members on an opposing side of the first panel; and a plurality of second panel retaining members, each of the second panel retaining members selectively seatable on ones of the post connecting members to accommodate a second panel of insulation between the first or second abutment surface of the second post on a side of the second panel and the second panel retaining members on an opposing side of the second panel.

The foregoing may cover only some of the aspects of the invention. Other and sometimes more particular aspects of the invention will be appreciated by reference to the following description of at least one preferred mode for carrying out the invention in terms of one or more examples. The following mode(s) for carrying out the invention are not a definition of the invention itself, but are only example(s) that embody the inventive features of the invention.

BRIEF DESCRIPTION OF THE DRAWINGS

At least one mode for carrying out the invention in terms of one or more examples will be described by reference to the drawings thereof in which.

DETAILED DESCRIPTION OF AT LEAST ONE MODE FOR CARRYING OUT THE INVENTION IN TERMS OF EXAMPLE(S)

Figure 1:
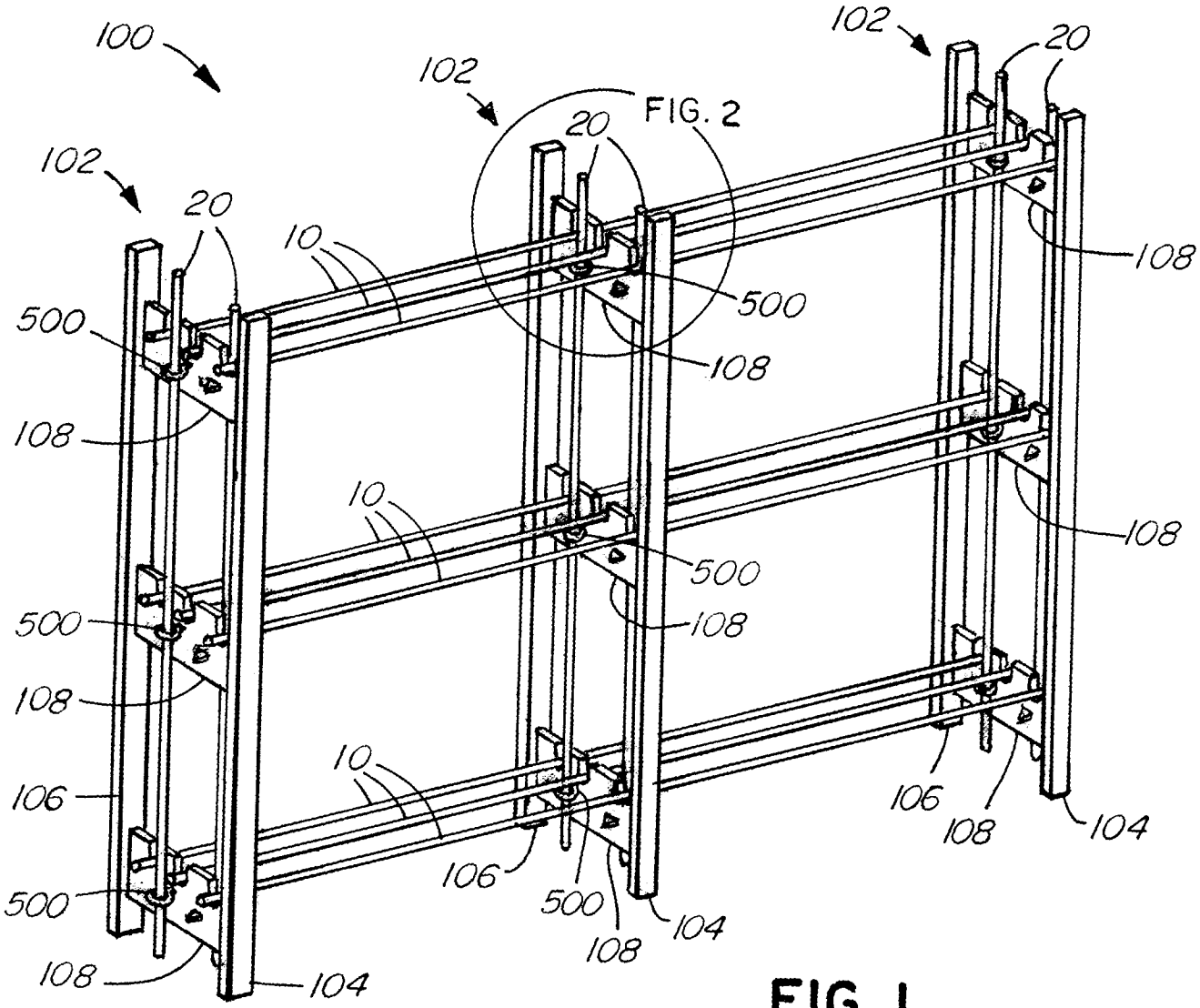
FIG. 1 is a perspective view according to a first embodiment of the invention of a section of rebar trestle with rebar installed.
Figure 2:
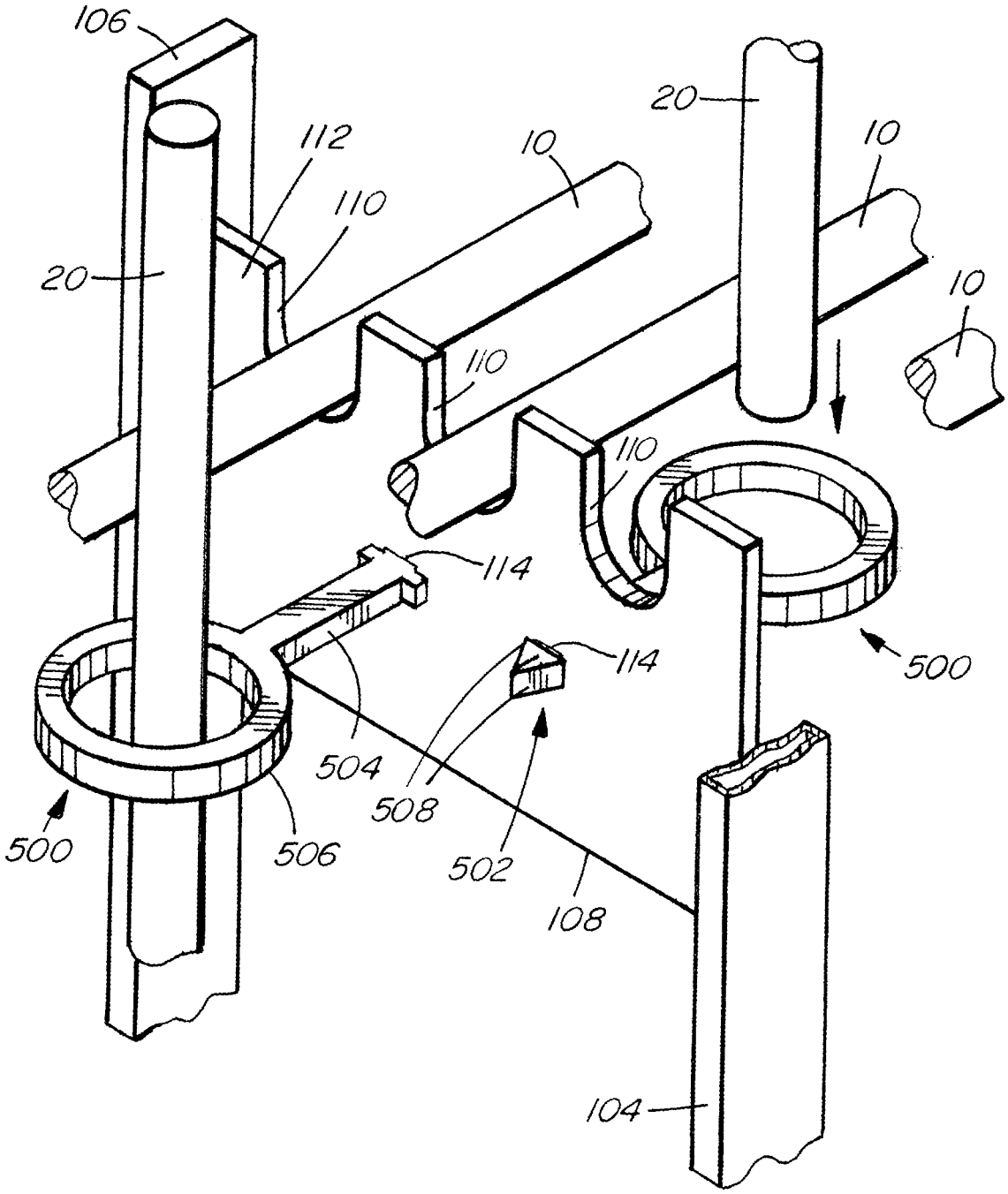
FIG. 2 is an enlarged partial perspective view of a rebar tray as indicated in FIG. 1 with portions of certain of the horizontal and vertical rebar removed for clarity.
Figure 3:
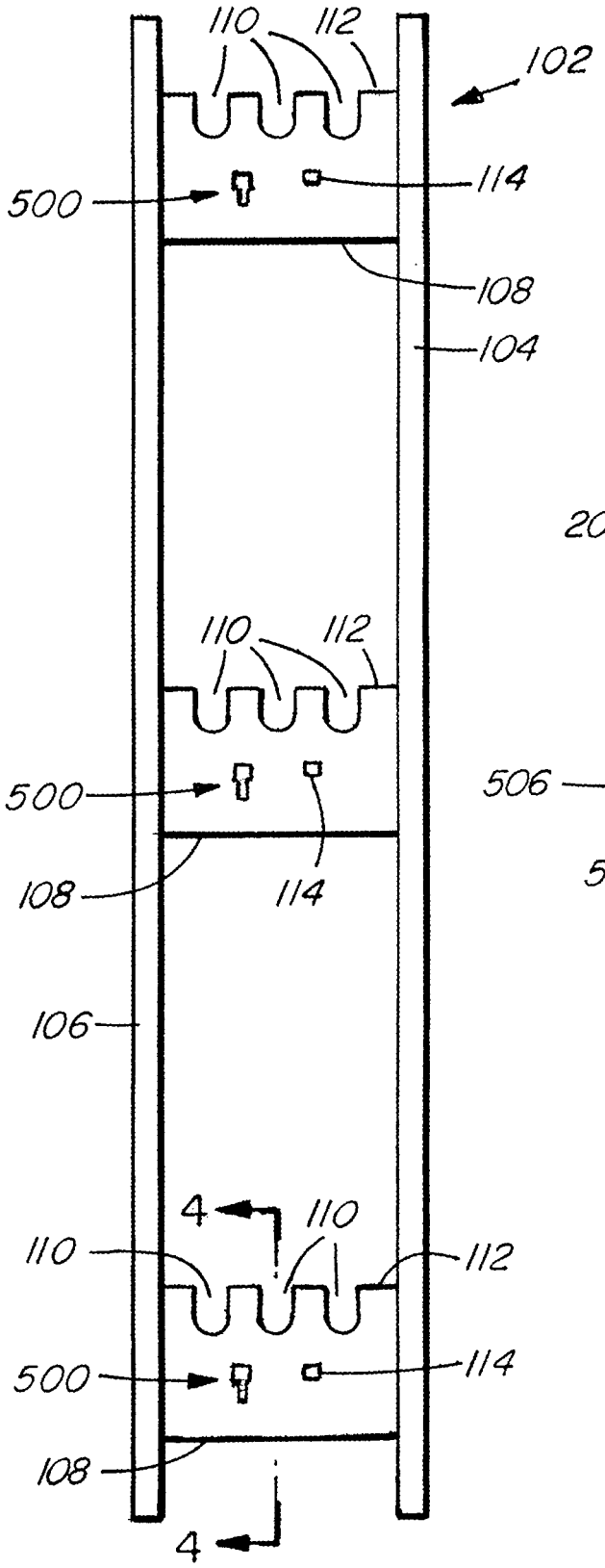
FIG. 3 is a front view of a vertical frame member of the rebar trestle of FIG. 1.
Figure 4:
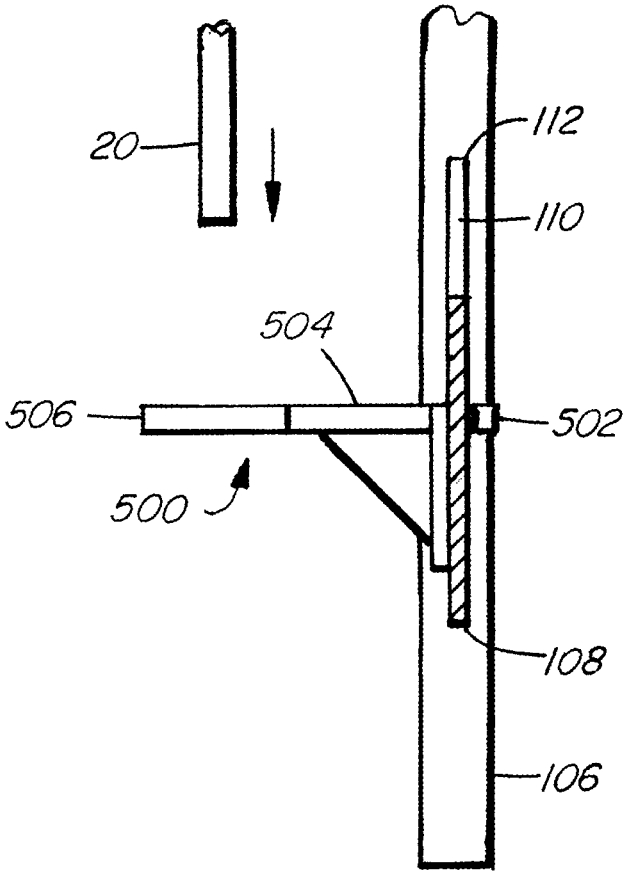
FIG. 4 is a partial section view of the vertical frame member of FIG. 3, taken along line 4-4 of FIG. 3.
Figure 5:
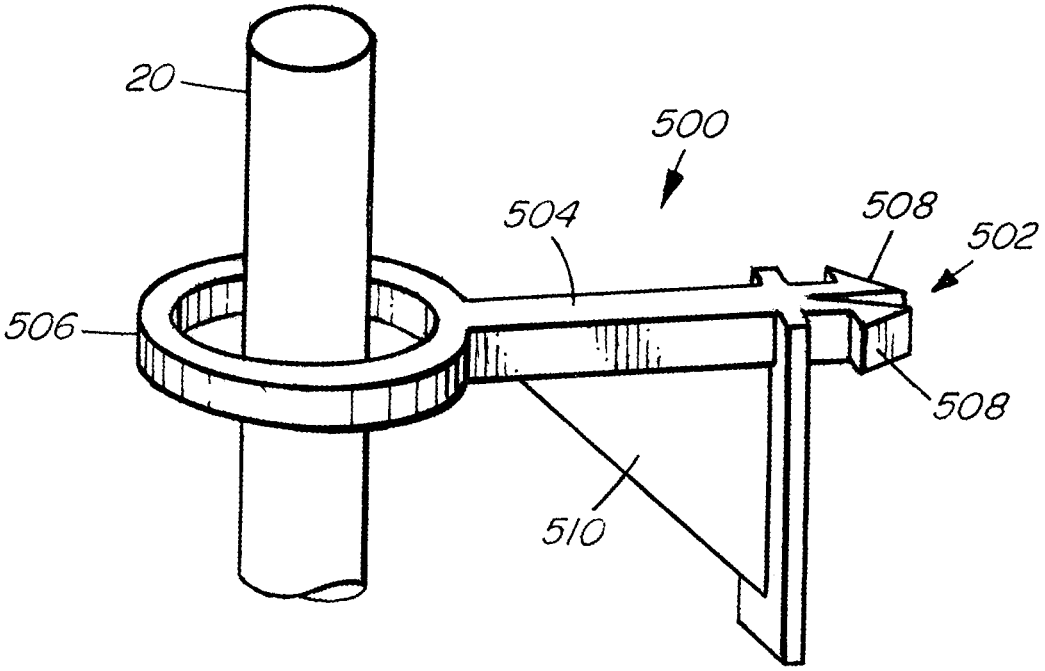
FIG. 5 is a perspective view of a rebar retaining member of the rebar trestle of FIG. 1.
Figure 6:
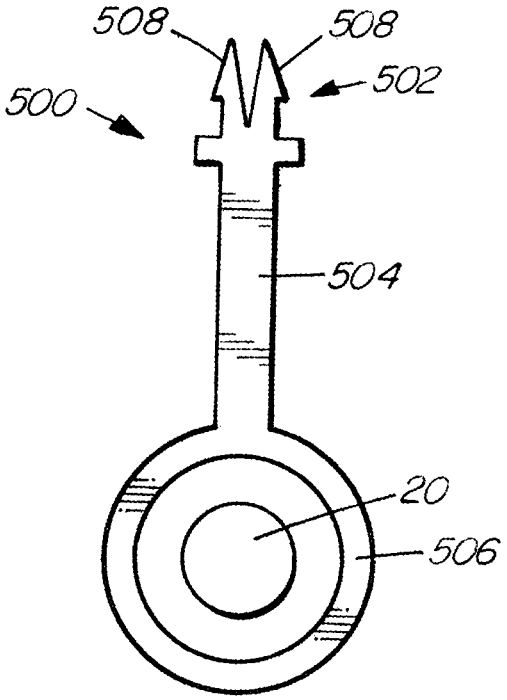
FIG. 6 is a top view of the rebar retaining member of FIG. 5.

Referring to FIGS. 1-3, according to one embodiment of the invention a rebar trestle system 100 comprises a plurality of longitudinally spaced apart vertical frame members 102. The frame members 102 may be mounted to a base structure (not shown) which may include, but is not limited to, a foundation, a footing, or a stub wall. In some embodiments, an L-channel beam (not shown) may be fixed to the foundation to provide a straight line for aligning the frame members to the placement of the future wall. Form members 102 may be fixed to the L-channel beam or simply abutted against the L-channel beam.

Each vertical frame member 102 comprises an interior stud 104 and a transversely spaced apart exterior stud 106. A plurality of rebar trays 108 extend transversely between the interior stud 104 and the exterior stud 106. According to the exemplary embodiment shown by FIGS. 1 and 2, each frame member 102 comprises three rebar trays 108. Rebar trays 108 of each frame member 102 are preferably spaced apart vertically in an even fashion so that respective rebar trays 108 of adjacent frame members 102 are substantially aligned. The vertical frame members 102 are preferably manufactured from a rigid polymer material such as high-density polyethylene (HDPE), polyvinyl chloride (PVC), acrylonitrile butadiene styrene (ABS), or a similar material.

Each rebar tray 108 comprises a plurality of slots 110 formed in an upper side 112 of the rebar tray 108. According to the exemplary embodiment shown in FIGS. 1 and 2, there are three slots 110 in each rebar tray 108, although depending upon the required characteristics of the finished wall more or fewer slots 110 may be used. Additionally, each rebar tray 108 of a frame member 102 need not comprise the same number of slots 110, although aligned trays 108 of adjacent frame members 102 preferably contain the same number of slots 110.

Each rebar tray 108 also comprises one or more apertures 114 formed through the rebar tray 108. According to the exemplary embodiment shown in FIGS. 1 and 2, there are two apertures 114 in each rebar tray 108, although this number may vary depending upon the required characteristics of the finished wall. Each aperture 114 is preferably positioned transversely between adjacent slots 110 of each rebar tray 108. It will be appreciated that the size and shape of the aperture could vary.

Referring to FIGS. 1-6, a rebar retaining member 500 is inserted into each aperture 114. The rebar retaining member 500 comprises a retention portion 502, a rebar receiving portion 506, and an arm 504 connecting the rebar receiving portion 506 to the retention portion 502. The receiving portion 506 may be in the shape of a ring as shown, although it will be appreciated that other shapes and forms are possible. The retention portion 502 preferably comprises elastically deformable hooks 508 that can be deflected inwards when inserted through the aperture 114 and then expand outward to hold the rebar retaining member 500 to the rebar tray 108. It will be appreciated that other forms of retention portion 502 for attachment of the rebar retaining member 500 to the rebar tray 108 are possible, including, but not limited to, threaded connections, bayonet-style connections, interference fit, and the like. When the rebar retaining member 500 is attached to the rebar tray 108, the rebar receiving portion 506 opens vertically. The arm 504 preferably further comprises an angle bracket 510 extending downwards from the arm 504 which supports and braces the rebar receiving portion 506 against the rebar tray 108. The arms 504 may be provided in a variety of lengths to account for different longitudinal spacing of vertical rebar 20 that may be necessary. The rebar retaining members 500 are also preferably manufactured from HDPE, PVC, ABS, or similar materials.

Referring to FIGS. 23-24, in a preferred embodiment of the rebar retaining member 500A the rebar receiving portion 506A comprises first and second clasp arms 512, 514 which together define a partial ring that surrounds the vertical rebar 20. A gap 516 between the first and second clasp arms is preferably sized to be somewhat less than the diameter of the vertical rebar 20. The clasp arms 512, 514 are preferably elastically deformable. This allows the vertical rebar 20 to be inserted in the rebar receiving portion 506A by firmly pushing the vertical rebar 20 through the gap 516 instead of threading the vertical rebar 20 through the rebar receiving portion 506 from above. The clasp arms 512, 514 should be stiff enough to prevent the vertical rebar 20 from pushing back through the gap 516 under its own weight. This improves installation speed and efficiency, particularly in relation to taller walls, while still ensuring the vertical rebar 20 remains in position.

Referring back to FIGS. 1, 2 and 4, to assemble the rebar skeleton of a wall using the rebar trestle system 100, a plurality of frame members 102 are erected along the length of the intended completed wall. Rebar retaining members 500 are then inserted into each aperture 114. Horizontal rebar 10 can then be laid into aligned slots 110 of adjacent frame members 102. Vertical rebar 20 can likewise be threaded through vertically adjacent rebar retaining members 500. The trays 108 and rebar retaining members 500 thus combine to maintain the horizontal rebar 10 and vertical rebar 20 in the correct position relative to each other according to the strength and durability requirements of the finished wall. Once the horizontal rebar 10 and vertical rebar 20 are placed in position, concrete forms (not shown) can be erected around the rebar trestle system 100 and concrete can be poured around the rebar trestle system 100. The rebar trestle system 100 will then be embedded in the finished wall.

The rebar trestle system 100 may also be integrated with an insulated concrete form system to form a wall construction system 200. Referring to FIGS. 7-10, according to another embodiment of the invention, a wall construction system 200 comprises a plurality of form members 202, a plurality of outer panels 300, and a plurality of inner panels 400 assembled together as shown and as described in further detail below. Each of the plurality of form members 202 is sequentially erected along the longitudinal direction of the intended wall. Each form member 202 is longitudinally spaced apart from the adjacent form member 202 sufficiently to allow each outer panel 300 and inner panel 400 to be inserted longitudinally between adjacent form members 202. The outer panels 300 and inner panels 400 are retained in position by structures on the form members 202 described in further detail below.

Figure 7:
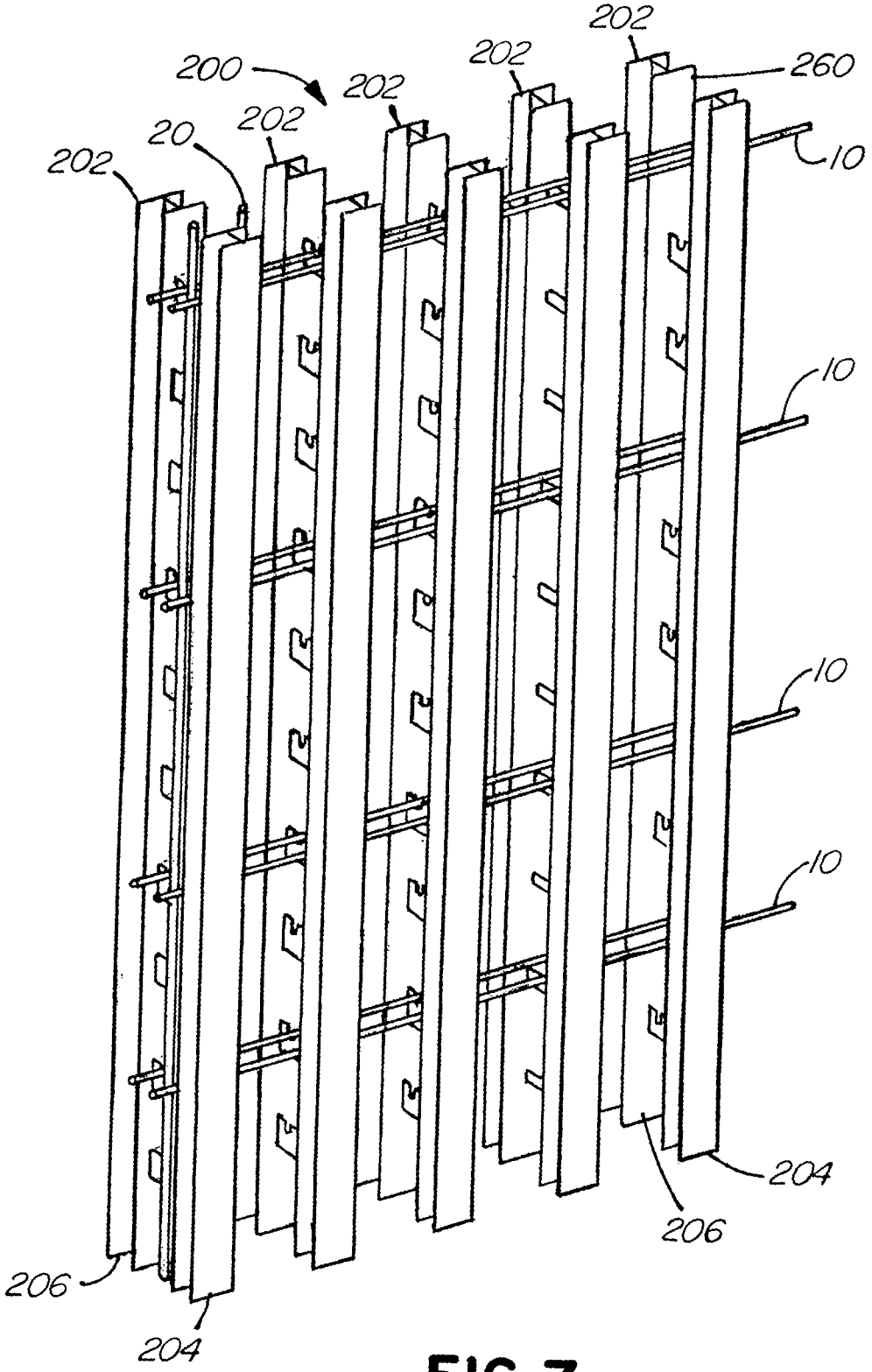
FIG. 7 is a perspective view according to a preferred embodiment of the invention of a section of wall construction system with rebar installed and inner and outer panels removed.
Figure 8:
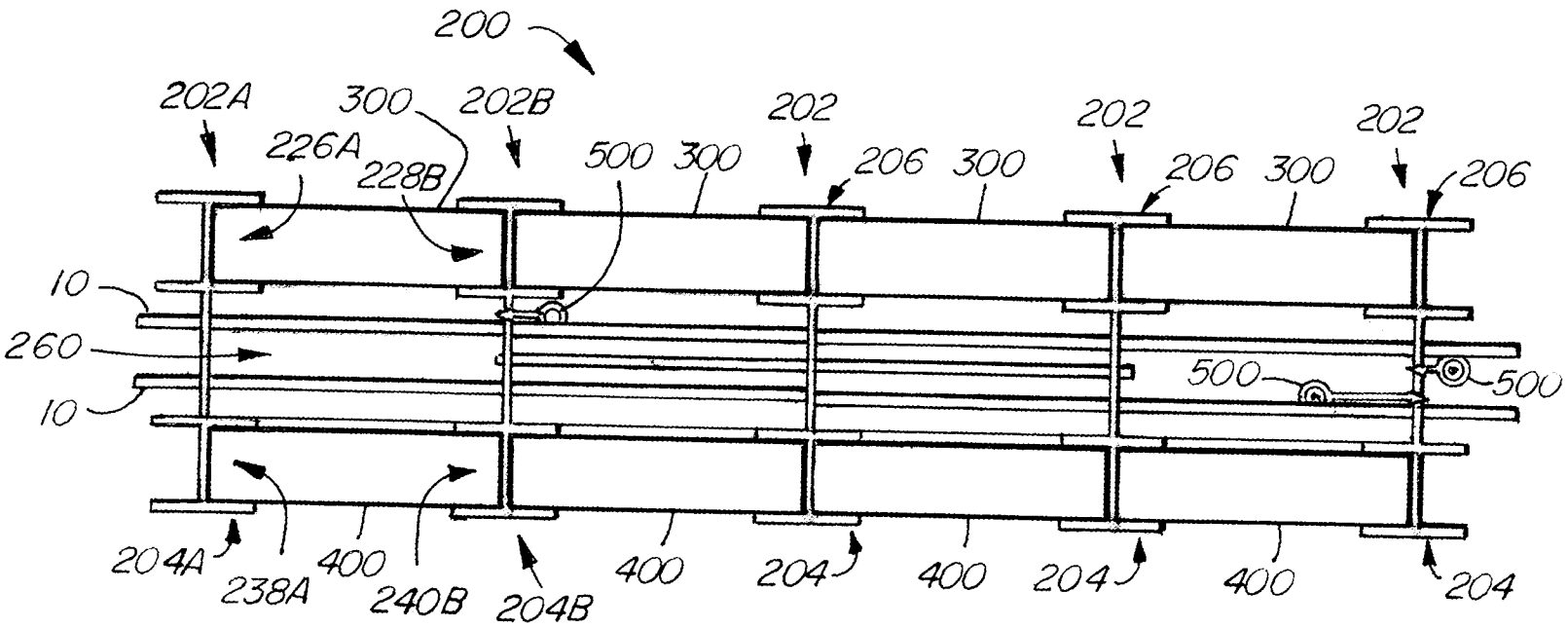
FIG. 8 is a top view of a section of wall construction according to the preferred embodiment of the invention with rebar and insulating panels installed.
Figure 9:
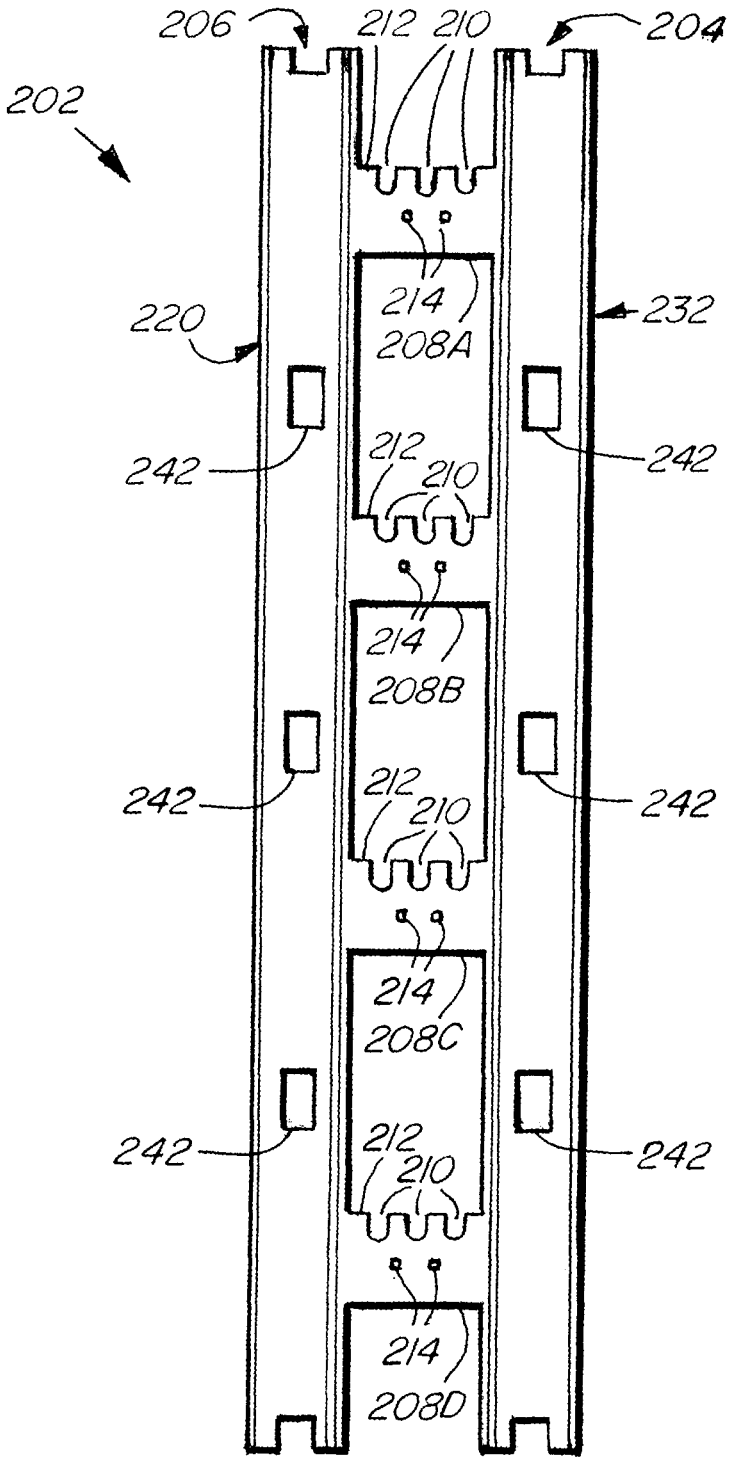
FIG. 9 is a front view of a form member of the wall construction system of FIG. 8.

Referring particularly to FIGS. 8 and 9, an individual form member 202 comprises an outer post 206 and a transversely spaced apart inner post 204. The outer post 206 is connected to the inner post 204 by a plurality of vertically spaced-apart interstitial webs 208. Preferably, there are four interstitial webs 208A, 208B, 208C, 208D as shown in FIG. 9, although it will be appreciated that there may be fewer, or more as shown in FIG. 7. Similar to the vertical frame members 102, each form member 202 is preferably manufactured from a rigid polymer such as HDPE, PVC, ABS, and the like.

Each interstitial web 208 further comprises a plurality of rebar troughs 210 formed in an upper edge 212 of the interstitial web 210. Horizontal reinforcing bar 10 can be laid into rebar troughs 210 of adjacent form members 202 to provide additional strength and durability to the finished wall. As shown in FIG. 8, there are preferably three rebar troughs 210 on each interstitial web 208 although the number of rebar troughs 210 may be modified as needed for the strength requirements of the finished building.

Each interstitial web 208 preferably further comprises a plurality of rebar retaining member ports 214 formed through the interstitial web 208. Preferably, each port 214 is transversely positioned between adjacent rebar slots 210. Rebar retaining members 500 may be inserted into each port 214 as described above in relation to the apertures 114 of the rebar trestle system 100.

Figure 10:
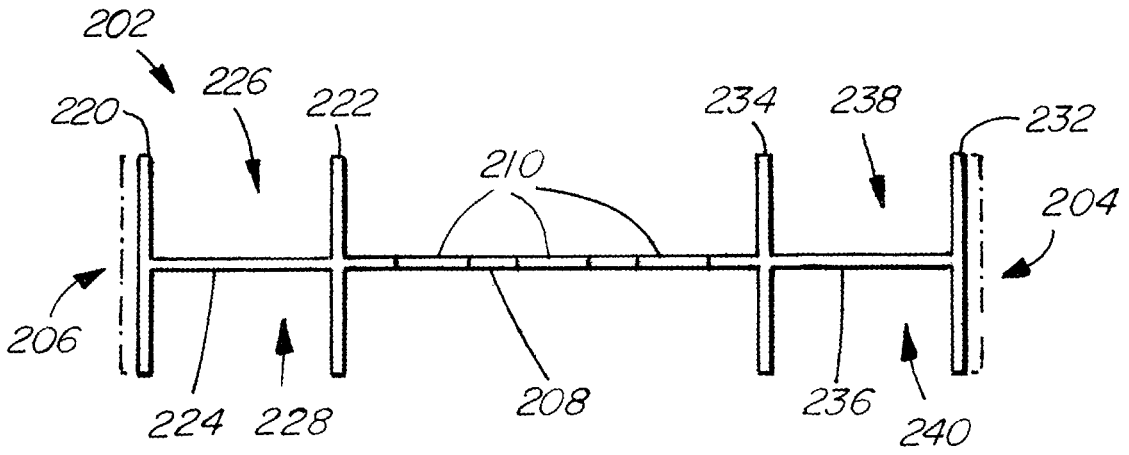
FIG. 10 is a top view of the form member of FIG. 9 with alternative flange thicknesses shown in broken outline.
Figure 11:
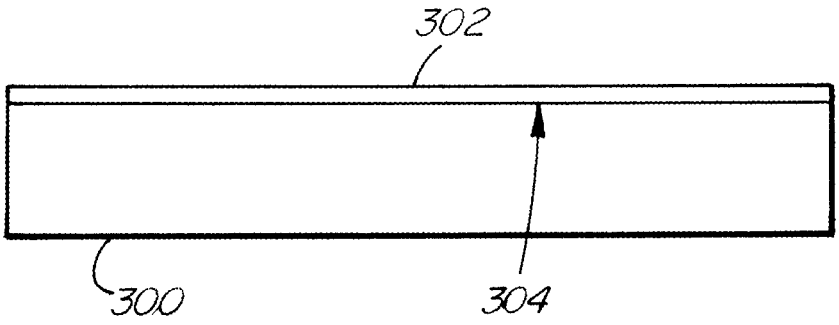
FIG. 11 is a top view of an outer panel of the wall construction system of FIG. 7 with a weather barrier attached.
Figure 12:
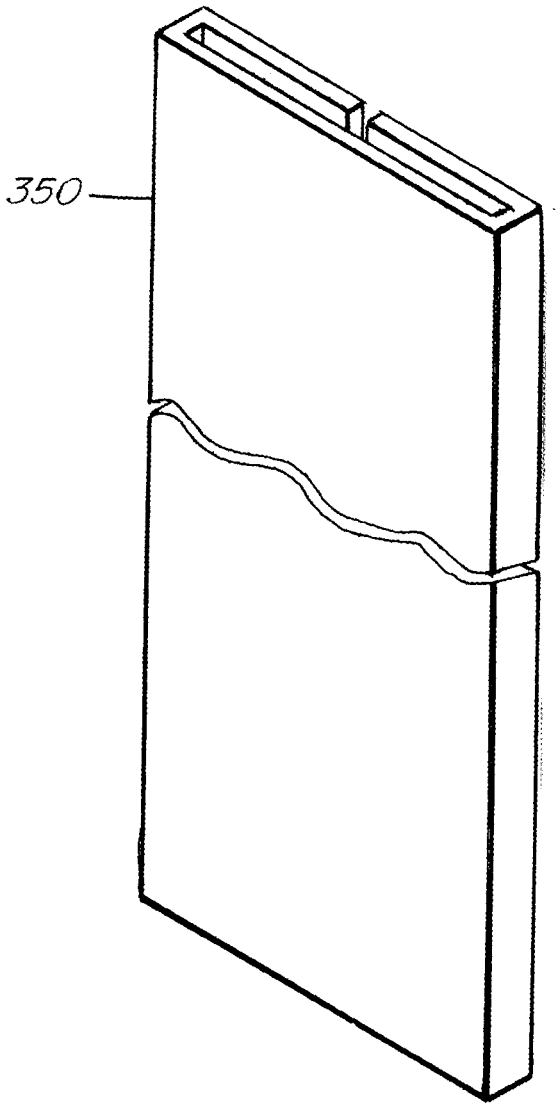
FIG. 12 is a perspective view of an exterior sheath for an exterior flange of the form member of FIGS. 9 and 10.
Figure 13:
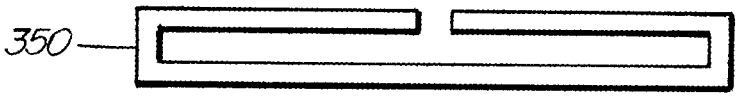
FIG. 13 is a top view of the exterior sheath of FIG. 12.

Referring particularly to FIGS. 9 and 10, the outer post 206 comprises an exterior flange 220 and a transversely spaced apart first interstitial flange 222. The exterior flange 220 and first interstitial flange 222 are connected by an outer post web 224. The exterior flange 220, first interstitial flange 222, and outer post web 224 together define a first channel 226 and second channel 228. The first channel 226 opens in a longitudinally opposed direction from the second channel 228 as shown.

Similarly, the inner post 204 comprises an interior flange 232 and a transversely spaced apart second interstitial flange 234. The interior flange 232 and second interstitial flange 234 are connected by an inner post web 236. The interior flange 232, second interstitial flange 234, and inner post web 236 together define a third channel 238 and fourth channel 240. The third channel 238 opens in a longitudinally opposed direction from the second channel 240 as shown. The outer post web 224 and inner post web 236 may optionally include pass-throughs 242 as shown in FIG. 9 for running plumbing or electrical conduit (not shown) along the completed wall.

Referring back to FIG. 8, an individual outer panel 300 is retained between adjacent frame members 202A, 202B by inserting the outer panel 300 into the first channel 226A of frame member 202A and the second channel 228B of frame member 202B. Similarly, an individual inner panel 400 is retained between adjacent frame members 202A, 202B by inserting the inner panel 400 into the third channel 238A of frame member 202A and the fourth channel 240B of frame member 202B. Preferably, the thickness of the outer and inner panels 300, 400 relative to the width of the first, second, third, and fourth channels 226, 228, 238, 240 is such that the panels snugly fit in the channels and are retained in place by friction alone. Alternatively, the first channel 226, second channel 228, third channel 238, and fourth channel 240 may further comprise retaining means to more securely retain the panels. These retaining means could be, but are not limited to, ridges, teeth, adhesives, or external fasteners such as nails or screws.

Preferably, the outer panels 300 and inner panels 400 are comprised of insulating materials. Commonly used insulating materials include, but are not limited to, expanded polystyrene, extruded polystyrene, and polyisocyanurate foams. Panels comprised of these materials are widely available in standard sizes, and the dimensions and spacing of the form members 202 are preferably designed to accommodate these standard panels. These materials are also at least somewhat compressible which contributes to a snug fit between the panels and the form members.

The outer panels 300 and inner panels 400, once installed between the form members 202, define an interstitial cavity 260 into which the concrete can be poured to form the completed wall. A snug fit between the panels and the form members is thus desirable to prevent leakage of the concrete slurry through the joints between the form members and the panels after pouring.

Figure 14:
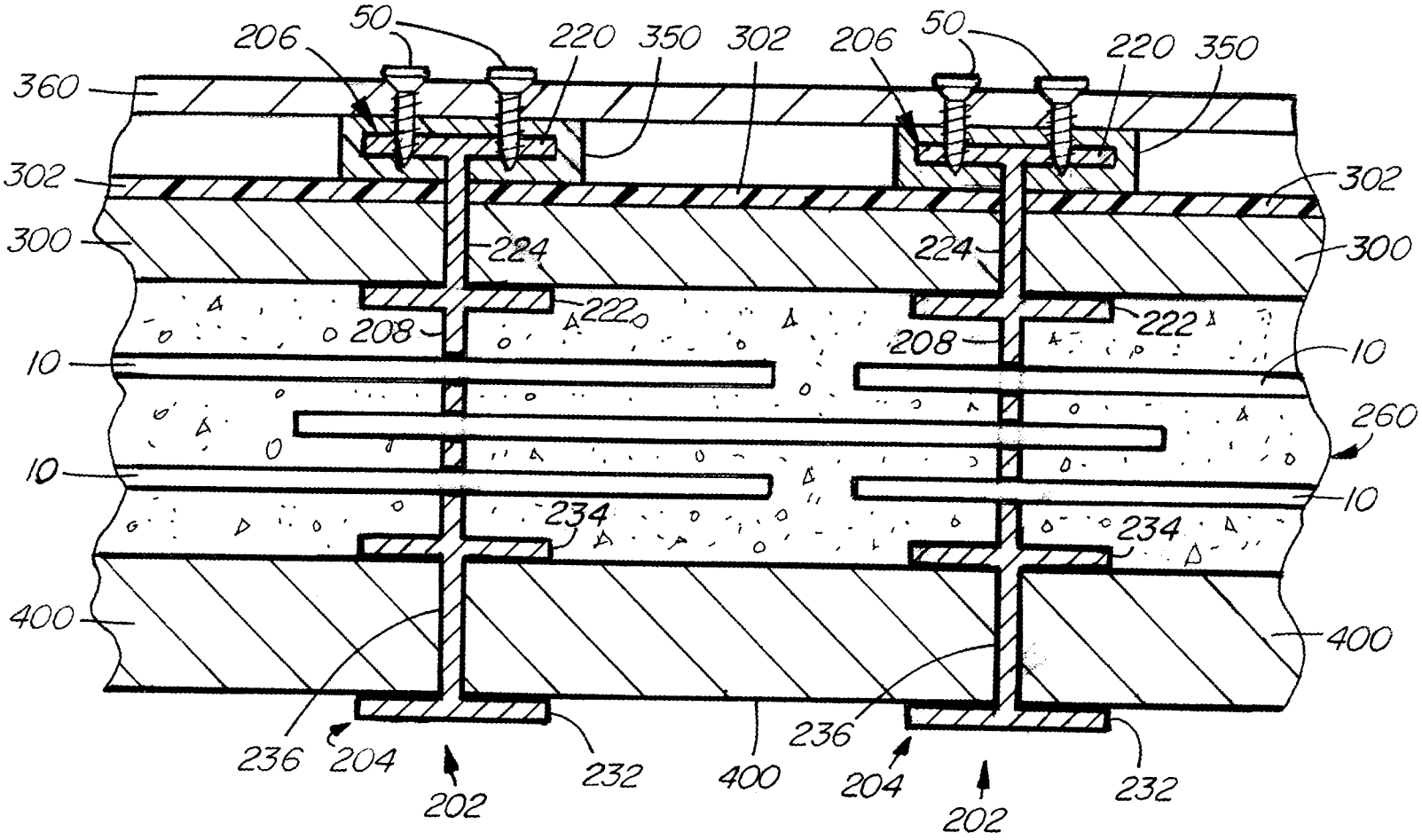
FIG. 14 is a top section view of a portion of wall completed using the wall construction system of FIG. 6, showing the air gap created by the exterior sheath between the exterior cladding and the exterior insulation panel.

Referring to FIGS. 11-14, the outer panels 300 preferably further comprise a weather barrier membrane 302 applied to an outer face 304 of the outer panel 300. Weather barrier membranes 302 are commercially available and include, but are not limited to products such as TYVEK BUILDING-WRAP®. The wall construction system 200 preferably further comprises a plurality of exterior sheathes 350, each of which are adapted to slide over an exterior flange 220. The dimensions of the exterior sheathes 350 are selected so that the combined thickness of the exterior flange 220 and exterior sheath 350 are equivalent to the air gap distance dictated by the local building codes in which the wall construction system 200 is used. Exterior cladding 360 can then be fastened to the exterior sheathes 350 and exterior flanges 220 by any fastening method known in the art, including, but not limited to, screws 50 as shown in FIG. 14. Perforation or other compromising of the weather barrier membrane 302 is thus avoided.

Referring back to FIG. 10, rather than using the exterior sheathes 350, the exterior flange 220 can simply be made thicker as shown in broken outline. That is, the thickness of the exterior flange 220 can be made to be equivalent to the air gap distance required by local building codes. This has the advantage of shorter construction times as it does not require an exterior sheath 350 to be attached to each exterior flange 220 prior to or during construction. However, it requires the wall construction system to be manufactured in multiple variants to account for different building codes in different jurisdictions. Nevertheless, the reduced time and cost at the construction site may be sufficient to offset the increased tooling costs associated with producing multiple variants. In some embodiments, the interior flange 232 may also be made thicker, as shown in broken outline in FIG. 10, to facilitate attachment interior wall finishing such as dry-wall panelling and the like (not shown) without perforating the interior panels 400.

Another embodiment of the invention is a method for constructing a wall using the wall construction system 200. First, the form members 202 are erected on a base structure (not shown). The form members 202 are secured to the base structure by suitable methods known in the art. Second, the vertical sheathes 350 are installed over exterior flanges 212. Third, the outer panels 300 and inner panels 400 are inserted longitudinally between adjacent form members 202 as described above. Fourth, rebar retainers 500 are installed in the interstitial webs 208 of the frame members 200 as necessary for the strength requirements of the final wall. Fifth, horizontal rebar 10 is laid into the rebar slots and vertical rebar 20 are threaded into the rebar retainers 500 as necessary. In some situations, it may be necessary, or simply easier, to perform the fourth and fifth steps before installing the outer panels 300 and inner panels 400. Finally, concrete is poured into the interstitial cavity 260 and allowed to cure. Exterior cladding 360 can then be affixed to the vertical sheathes 350 to complete the exterior of the wall, a section of which is shown in FIG. 14.

The rebar trestle system 100 and wall construction system 200 may be assembled with ease by builders and are expected to substantially reduce building time. With the use of outer panels 300 having an applied weather barrier membrane 302, building time is further reduced as builders will not need to apply housewrap to various exterior surfaces prior to affixing external cladding.

Smooth interior surfaces of the frame members 102 and the form members 202 and smooth surfaces of panels 300 and 400 allow for the smooth pouring of concrete and the reduction or elimination of voids that can often exist in prior art wall systems.

The rebar trestle system 100 and wall construction system 200 are also energy efficient compared to prior art wall systems which utilize metal or wood studs.

Figure 15:
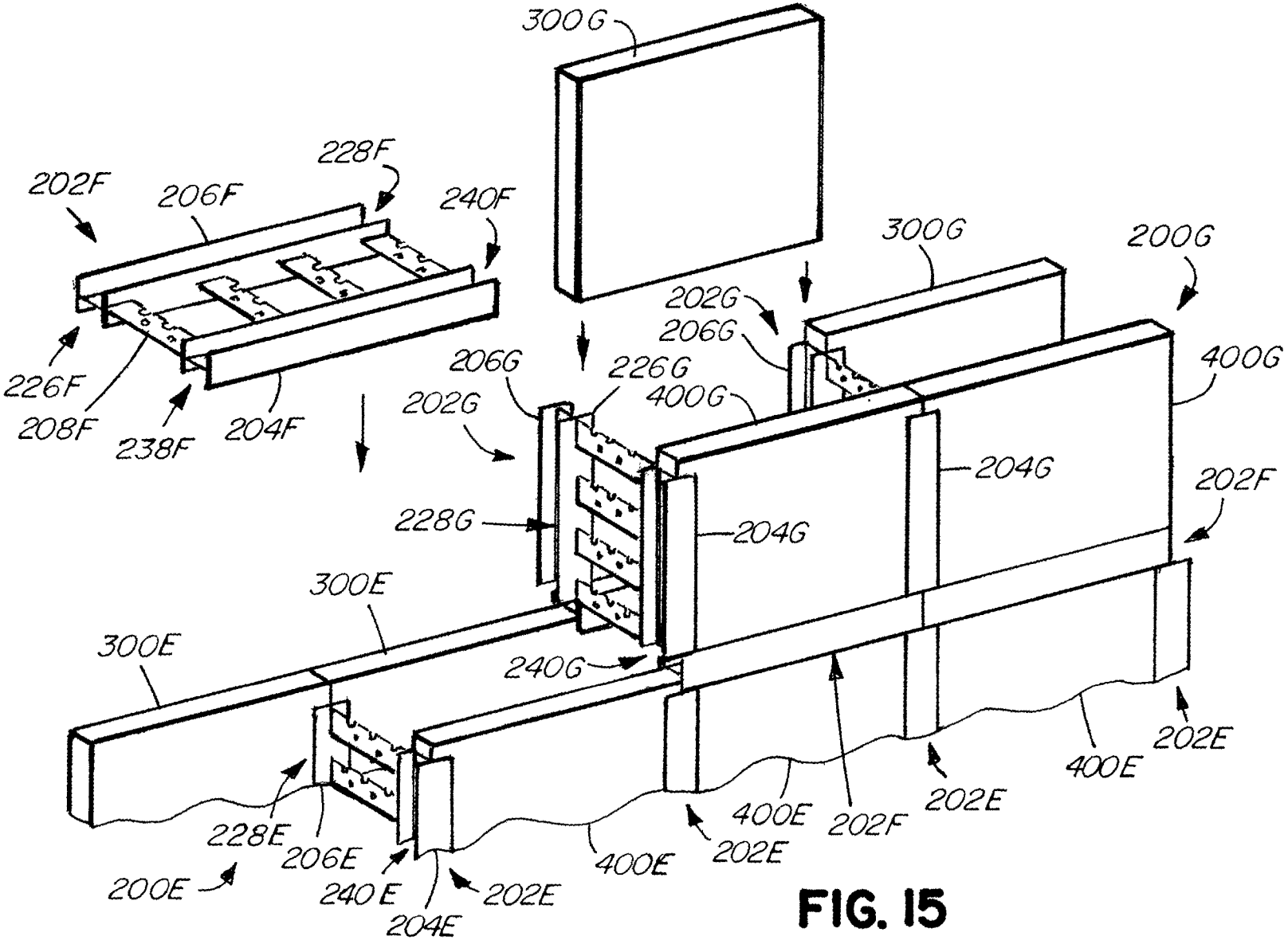
FIG. 15 is a perspective view of an embodiment according to the invention showing a partially complete multi-layer wall construction.
Figure 16:
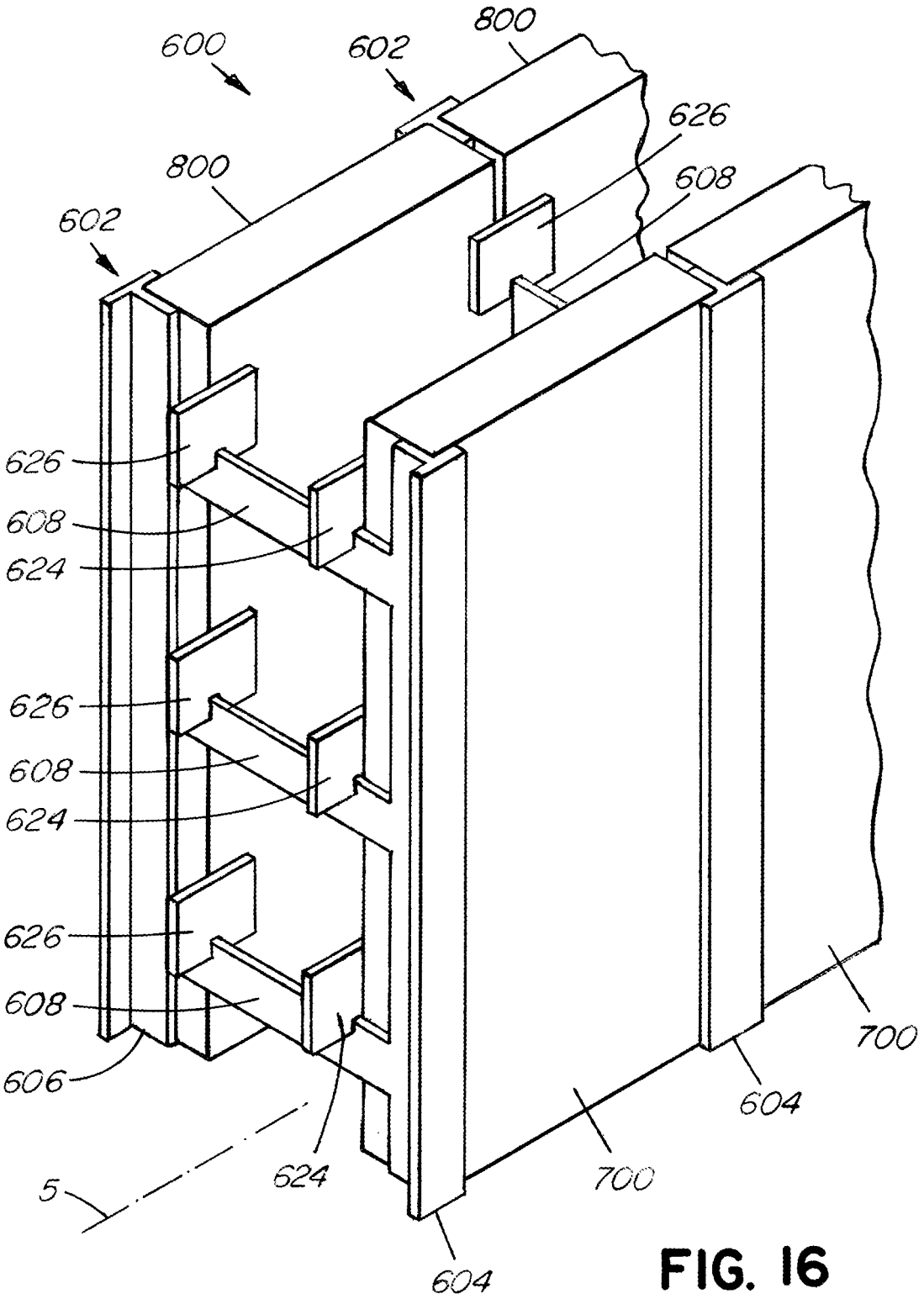
FIG. 16 is a perspective view according to a second preferred embodiment of the invention of a section of a modular wall construction system.
Figure 17:
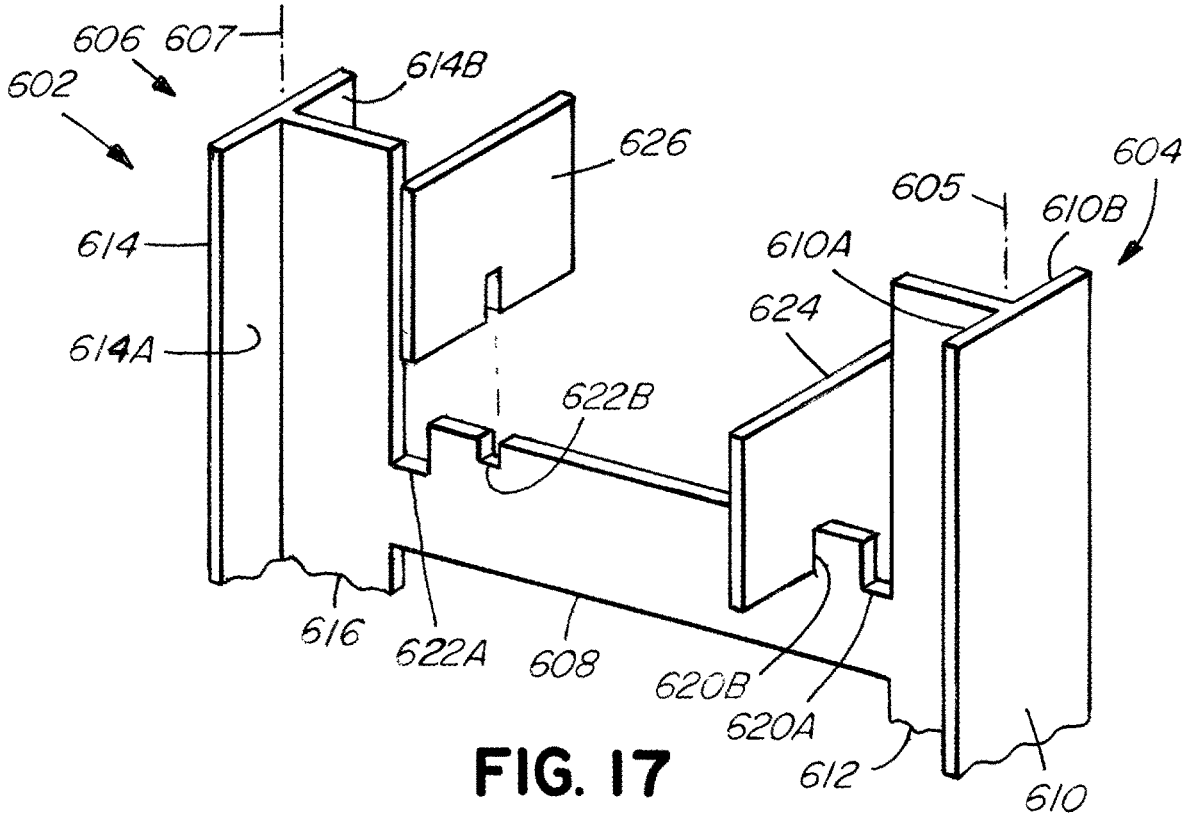
FIG. 17 is a perspective view of a portion of a modular form member of the modular wall construction system of FIG. 16 showing installation of panel retaining members.

Whereas existing prior art ICF block systems are typically only used for the foundation of buildings, the wall construction system 200 can be utilized in multi-story buildings for walls up to at least six floors. Referring to FIG. 15, a first layer of wall construction system 200E is assembled as described above. Once the first layer of wall construction system 200E is in place, rebar may be installed and concrete poured for the first layer of wall. Alternatively, multiple layers of wall construction system 200E, 200G may be erected before the rebar is installed and the concrete poured as shown. In order to connect a second layer of wall construction system 200G to the first layer of wall construction 200E, horizontal form members 202F are laid over the tops of the outer panels 300E and inner panels 400E such that the outer panels 300E insert into the first channel 226F of the horizontal form members 202F and the inner panels 400E insert into the third channel 238F of the horizontal form members 202F. The second layer of wall construction system 200G is then erected by inserting the outer panels 300G into the second channel 228F of the horizontal form members 202F and inserting the inner panels 400G into the fourth channel 240F of the horizontal form members 202F. Form members 202G are interposed between successive sets of outer panels 300G and inner panels 400G. The form members 202G may rest on top of the horizontal form member 202F or may be fastened to the horizontal form member 202F. By alternating horizontal form members and successive wall construction systems, walls of the desired height can be constructed.

It will be recognized that inner panels 400 and outer panels 300 will be taller than the first layer form members 202E by half a flange length in order to connect the horizontal form members 202F. Similarly, subsequent upper layer form members, such as form members 202G, will be shorter than the base layer form members 202E. The form members may be provided to the construction site pre-sized to the correct lengths, or may be cut to length on site.

While outer panels 300E are shown as inserting into first channel 226F of horizontal form members 202F and inner panels 400E are shown as inserting into third channel 238F, it will be appreciated that other orientations of the horizontal form members 202F will be possible. Indeed, depending upon the position of vertical rebar in the wall, it may be necessary to orient some horizontal form members differently so that the interstitial webs 208F do not obstruct the placement of vertical rebar.

In some embodiments, horizontal form members may be laid in place during pouring of the foundation, such that the horizontal form members are embedded by half a flange length in the foundation. The first layer may then be erected by inserting the inner panels 400 and outer panels 300 into the second and fourth channels of the embedded horizontal form member. With this alternative construction method, all the form members used can be of the same length (that being shorter than the inner and outer panels by a flange length). This will further improve on-site efficiency as only one length of form member need be provided, removing the need for on-site cutting or for sorting and selecting the necessary form member length for the given layer of wall.

Referring to FIGS. 16 to 18 and 20A, according to another embodiment of the invention a modular concrete form system 600 comprises a plurality of modular form members 602, a plurality of first panels 700, and a plurality of second panels 800 assembled together as shown and as described in further detail below. Each of the plurality of modular form members 602 is sufficiently spaced along a perimeter 5 (a portion of which is indicated by the dotted line of FIG. 16)

of the intended wall to allow each first panel 700 and second panel 800 to be inserted between adjacent modular form members 602 parallel to the perimeter 5. The first panels 700 and second panels 800 are retained in position by structures on the modular form members 602 described in further detail below. The first panels 700 and second panels 800 are preferably made from an insulating material, and the modular form members 602 are preferably made from a rigid polymer such as HDPE, PVC, ABS, and the like.

Each modular form member 602 comprises a first post 604 and a second post 606 separated by a plurality of post connecting members 608. The first post 604 comprises a first flange 610 and first web 612. The second post 606 comprises a second flange 614 and a second web 616. The post connecting members 608 connect the first web 612 to the second web 616.

In some embodiments, the first and second posts 604, 606 have a first and second longitudinal axis 605, 607, respectively, extending in a vertical direction. The first and second webs 612, 616 extend along the first and second longitudinal axes 605, 607, respectively. The first flange 610 extends from the first web 612 parallel to the perimeter 5 to form a first abutment surface 610A of the first flange 610 parallel to the perimeter 5 and a second abutment surface 610B of the first flange 610 parallel to the perimeter 5 and opposed to the first abutment surface 610A across a plane transverse to the perimeter 5 and passing through the first web 612. Similarly, the second flange 614 extends from the second web 616 parallel to the perimeter 5 to form a first abutment surface 614A of the second flange 614 parallel to the perimeter 5 and a second abutment surface 614B of the second flange 614 parallel to the perimeter 5 and opposed to the first abutment surface 614A across a plane transverse to the perimeter 5 and passing through the second web 614. Therefore, the first and second posts 604, 606 are T-shaped in cross section and the first and second abutment surfaces 610A, 6108 of the first flange 610 oppose the first and second abutment surfaces 614A, 614B of the second flange 614 across the perimeter 5 of the intended wall.

Each post connecting member 608 preferably comprises one or more first panel retaining member slots 620 formed in an upper surface 618 of the post connecting member 608 proximate to the first web 612 and most preferably comprises two first panel retaining member slots 620A, 620B. Each post connecting member 608 also preferably comprises one or more second panel retaining member slots 622 formed in the upper surface 618 proximate to the second web 616 and most preferably comprises two second panel retaining slots 622A, 622B. The distance between the first flange 610 and each respective first panel retaining member slot 620 will preferably correspond to a common available thickness of insulating panel. As a non-limiting example, the distance between the first flange 610 and the first panel retaining member slot 620A may correspond to a two-inch (5.1 cm) thick panel, while the distance between the first flange 610 and the first panel retaining member slot 620B may correspond to a three-inch (7.6 cm) thick panel. Similarly, the distance between the second flange 614 and each of the second panel retaining member slots 622 will preferably also correspond to the common available thicknesses. As a non-limiting example, the distance between the second flange 614 and the second panel retaining member slot 622A may correspond to a two-inch (5.1 cm) thick panel, while the distance between the second flange 614 and the second panel retaining member slot 622B may correspond to a three-inch (7.6 cm) thick panel.

The first post 604, second post 606 and post connecting members 608 are preferably unitary such that the modular form member 602 can be conveniently manufactured in a minimal number of steps. As non-limiting examples, the spacing form member could be produced by injection molding, or by extrusion followed by stamping to remove excess material from between adjacent post connecting members 608. However, the first post 604, second post 606, and post connecting members 608 could also be made separately and then joined together using any convenient method, including but not limited to, welding, adhesives, and mechanical fasteners.

Each modular form member 602 further comprises a plurality of first panel retaining members 624 and a plurality of second panel retaining members 626. The first and second panel retaining members 624 and 626 are separate components from post connecting members 608, but may be selectively seated upon the post connecting members 608, preferably in one of the first panel retaining member slots 620 and one of the second panel retaining member slots 622, respectively. Preferably, there is one first panel retaining member 624 and one second panel retaining member 626 per post connecting member 608, although other configurations of first panel retaining members 624 and second panel retaining members 626 may be used depending upon the requirements of the finished wall. The first panel retaining members 624 and second panel retaining members 626 are preferably rectangular plates as shown, although other shapes and configurations are possible without departing from the scope of the invention.

Figure 18:
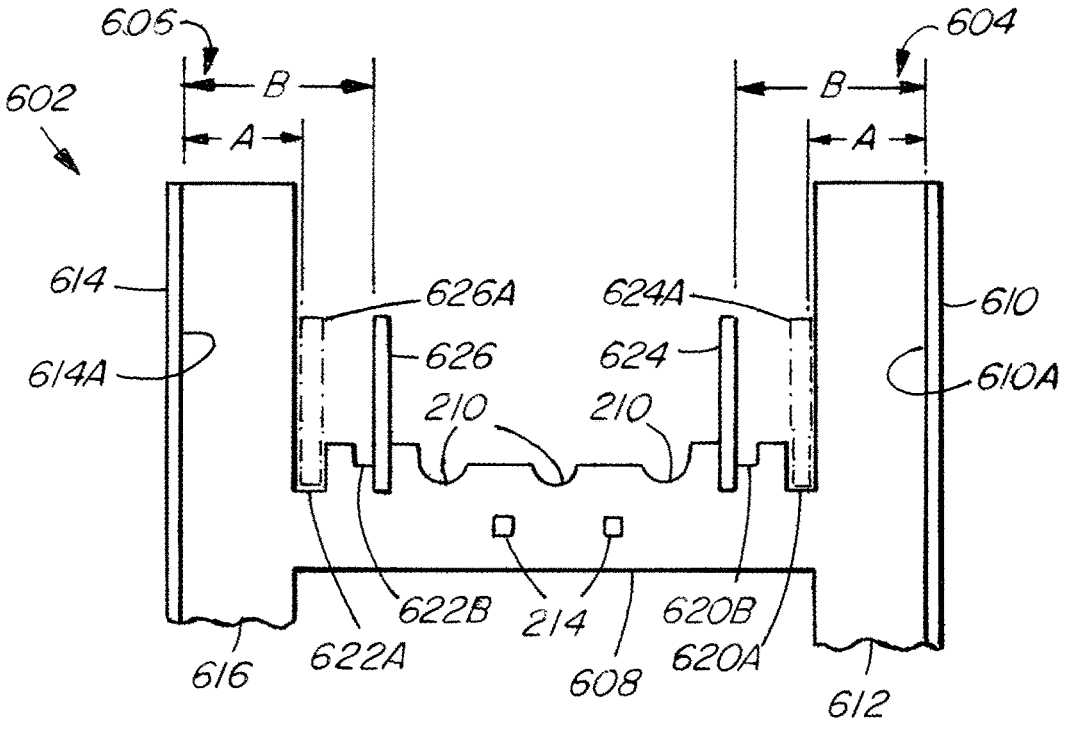
FIG. 18 is a front view according to a third preferred embodiment of the invention of a portion of a modular form member with rebar retention features.

Each first panel retaining member 624 inserts into one of the first panel retaining member slots 620 of each post connecting member 608. Where there are two first panel retaining member slots 620A, 620B in post connecting member 608, the first panel retaining member 624 is inserted in the first panel retaining member slot 620 corresponding to the desired thickness of first panel 700 to be used in the finished wall. Referring in particular to FIG. 18, when the first panel retaining member 624 is inserted in first panel retaining member slot 620B, there is a separation distance B between first and second abutment surfaces 610A, 610B and the first panel retaining member 624. When the first panel retaining member 624 is instead inserted in first panel retaining member slot 620A as shown by panel retaining member 624A in broken outline, there is a separation distance A between the first and second abutment surfaces 610A, 610B and the panel retaining member 624A. As non-limiting examples, separation distance A may be two inches (5.1 cm) and separation distance B may be three inches (7.6 cm), corresponding to the modular wall construction system being configured to retain two-inch thick first panels 700 and three-inch thick first panels 700, respectively. Similarly, each second panel retaining member 626 inserts into either the second panel retaining member slot 622B or the second panel retaining member slot 622A as indicated by panel retaining member 626A in broken outline. The second panel retaining member slot 622A, 622B chosen will also correspond to the desired thickness of second panel 800 to be used in the finished wall. An individual spacing form member 602 of fixed dimensions can therefore be used with multiple different thicknesses of first panels 700 and second panels 800 as may be required, for example for the hydrostatic strength requirements of concrete to be poured, or for the insulating characteristics needed in the finished wall. First panels 700 of differing thicknesses from the second panels 800 may also be accommodated.

Figure 20A:
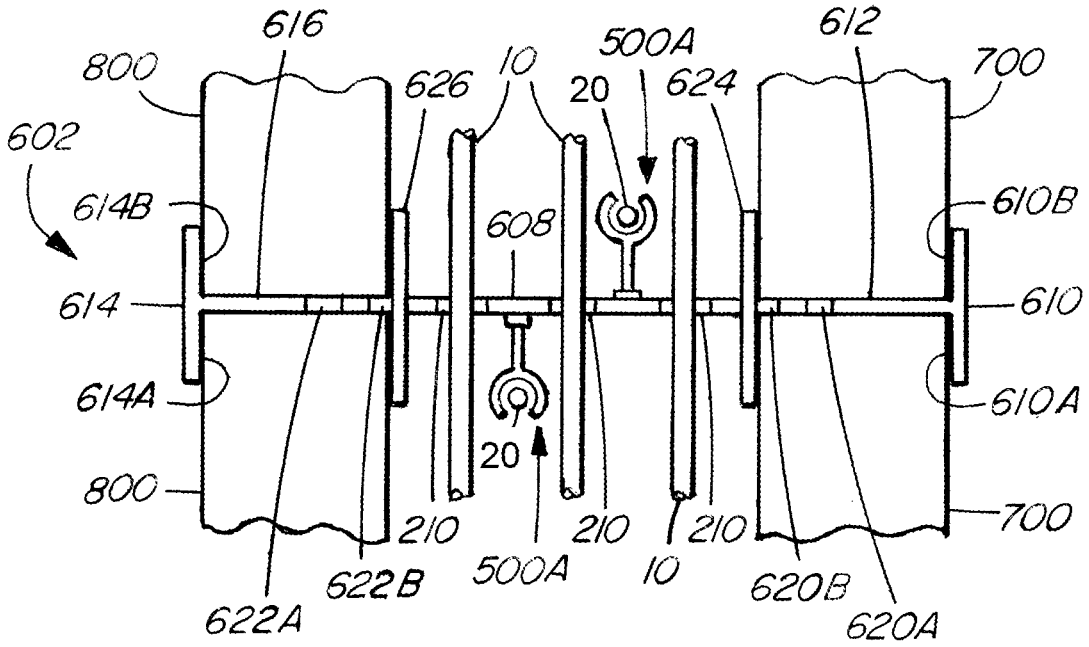
FIG. 20A is a partial top view of the modular wall construction system of FIG. 18.

Referring in particular to FIG. 20A, When the first panel retaining members 624 and second panel retaining members 626 are attached to the spacing form members 602, each first panel 700 can be retained between the first flanges 610 and first panel retaining members 624 of adjacent spacing form members 602 as shown. Similarly, each second panel 800 can be retained between the second flanges 614 and second panel retaining members 626 of adjacent spacing form members 602. In some embodiments, the first panel 700 is accommodated between the first or second abutment surface 610A, 6108 of the first flange 6108 on a side 702 of the first panel 700 and the first panel retaining members 624 on an opposing side 704 of the first panel 700. Similarly, the second panel 800 is accommodated between the first or second abutment surface 614A, 614B of the second flange 614 on a side 802 of the second panel 800 and the second panel retaining members 626 on an opposing side 804 of the second panel 800. The abutment surfaces 610A, 610B, 614A, 614B and panel retaining members 624, 626 may be flat and smooth where they contact the first or second panel 700, 800, respectively, or they may include texturing, ridges, teeth, adhesives, and the like to more firmly grip the panels.

Figure 19:
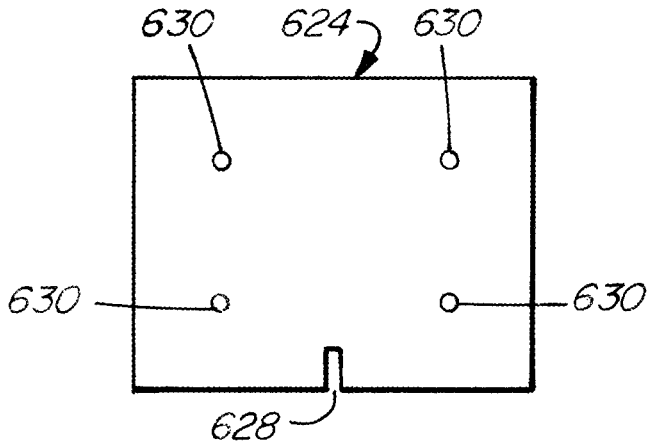
FIG. 19 is a side view of the first panel retaining member of FIG. 16.

Referring to FIG. 19, Each first panel retaining member 624 and second panel retaining member 626 preferably further comprise a slit 628. When the panel retaining member is inserted into a respective slot, the slit 628 interlocks with the slot to ensure the panel retaining member is firmly seated on the respective post connecting member 608. Each inner panel retaining member 624 and outer panel retaining member 626 preferably further comprises one or more fastener holes 630. A fastener (not shown), for example a nail or screw, may be driven through a fastener hole 630 and into the respective panel in order to further secure the panel between the respective panel retaining member and respective flange.

For certain applications, the first panel retaining members 624 and second panel retaining members 626 are identical and differ only by whether they are inserted into the first panel retaining member slots 620 or the second panel retaining member slots 622 of the post connecting member 608. Identical first panel retaining members 624 and second panel retaining members 626 are advantageous, as the concrete form system 600 will then require only four types of components (three if the first panels 700 and second panels 800 are to have the same thickness and insulating value per inch of thickness) in addition to the concrete and, if used as described in further detail below, the rebar retaining members 500 and the reinforcing bar, those four types of components being the modular form members 602, the first panels 700, the second panels 800, and the panel retaining members 624, 626. In some embodiments where the panels 700, 800 are to have the same thickness and insulating value per unit thickness, only three types of components are needed. This reduces manufacturing complexity and can decrease the erection time of the modular concrete form system 600 since the panel retaining members 624, 626 do not need to be separated from each other and can be used in any position. In other applications, the first panel retaining members 624 and second panel retaining members 626 may differ in dimensions as may be required for the characteristics of the desired finished wall. In still other applications, it may be advantageous to have first panel retaining members 624 and second panel retaining members 626 differ in at least thickness so that the first panel retaining members 624 only insert in to the first panel retaining member slots 620 and the second panel retaining members 626 only insert in the second panel retaining member slots 622. This will make erection of the second wall construction system 600 less error-prone since the panel retaining members can only be used with the proper respective slot.

Referring back to FIG. 18 in particular, each post connecting member 608 preferably comprises the one or more troughs 210 described previously, formed in an upper surface 632 of the spacing web 608. The one or more troughs 210 are each adapted to receive a horizontal reinforcing bar 10 as shown. Three troughs 210 are shown, but it will be recognized that more or fewer may be required as necessary for a given thickness and strength of the finished wall. Each post connecting member 608 preferably also comprises the one or more ports 214 which are each adapted to receive a rebar retaining member 500. Accordingly, the concrete form system 600 can be used to support an internal rebar skeleton as previously described.

Figure 20B:
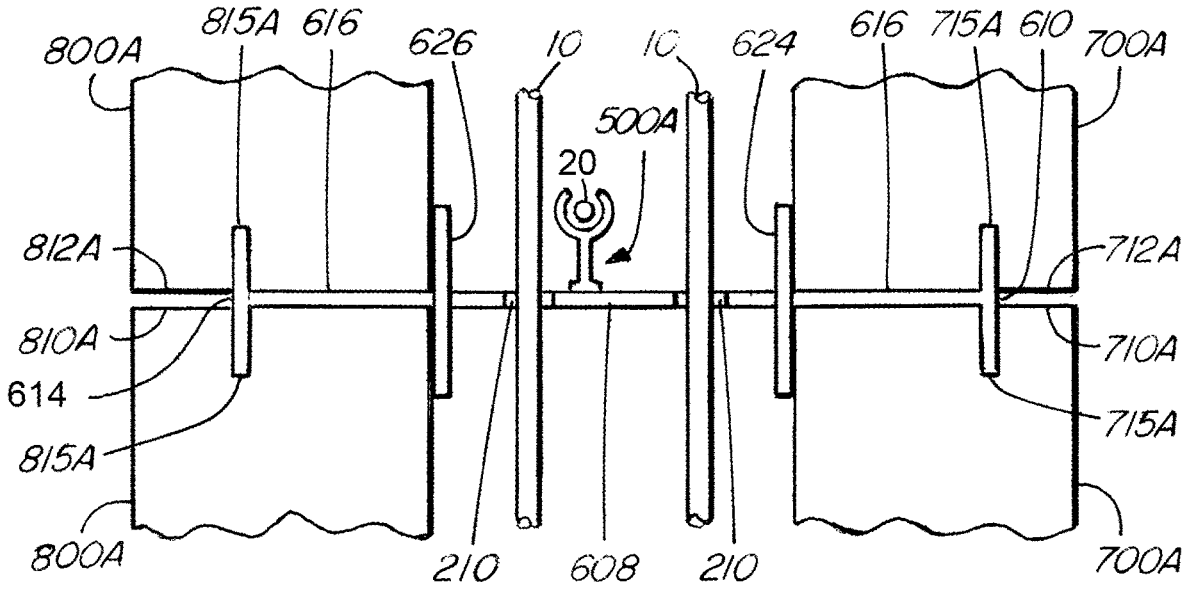
FIG. 20B is a partial top view of the modular wall construction system of FIG. 18 showing an alternative embodiment of the insulation panels.
Figure 21:
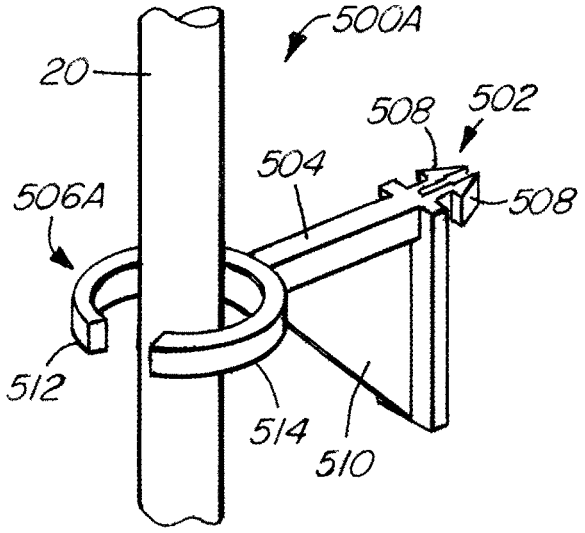
FIG. 21 is a perspective view of an alternative embodiment of the rebar retaining member of FIG. 5.
Figure 22:
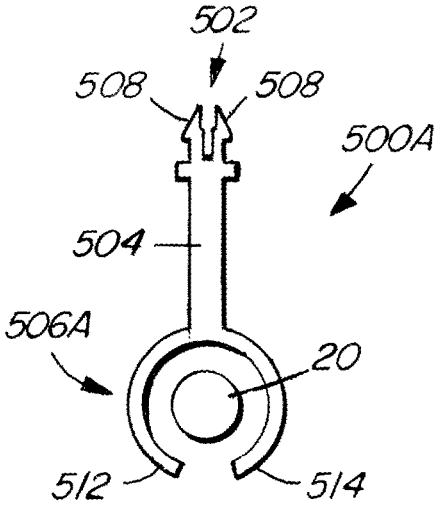
FIG. 22 is a top view of the rebar retaining member of FIG. 21.

Referring to FIG. 20B. The first panels 700 and second panels 800 may be made available in an alternative thickness 700A, 800A, respectively. The thicker panels 700A, 800A comprise a first edge 710A, 810A and second edge 712A, 812A. Edge cut-outs 715A, 815A are formed in each of the first edges 710A, 810A and second edges 712A, 812A. the first flange 610 inserts at least partly into the edge cut-out 715A when the thicker first panel 700A is retained between the first flange 610 and first panel retaining member 624. Likewise, the second flange 614 inserts at least partly into the edge cut-out 815A when the thicker second panel 800A is retained between the second flange 614 and second panel retaining member 626. This allows thicker panels with higher corresponding insulating value to be used with one form member without affecting the dimensions of the internal concrete of the finished walls, which may need to be of a specified thickness for strength requirements.

Once assembled together, the modular form members 602, first panels 700, and second panels 800 together define, at least in part the interstitial cavity 260 into which concrete can be poured to construct the wall. The modular concrete form system 600 preferably becomes integral to the wall once the concrete has cured.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

The invention claimed is:

1. A modular concrete form system for constructing a wall, comprising:

a plurality of modular form members spaced along a perimeter of said wall to be constructed, each of said modular form members comprising:

a first post, said first post comprising a first flange and a first web;

a second post, said second post comprising a second flange and a second web; and a plurality of post connecting members each integrally formed with and extending between said first web and said second web, each of said post connecting members comprising one or more apertures each adapted to receive a rebar retaining member, wherein each of said rebar retaining members is adapted to receive a vertical reinforcing bar, and wherein each of said rebar retaining members comprises a retention clip insertable into said one or more apertures, an arm, and a rebar receiving portion, each of said post connecting members further comprising an upper surface and one or more troughs formed in said upper surface, each of said one or more troughs adapted to receive a horizontal reinforcing bar;

a plurality of first panel retaining members, each of said first panel retaining members selectively seatable on one of said post connecting members of one of said modular form members in proximity to said first web thereof;

a plurality of second panel retaining members, each of said second panel retaining members selectively seatable on one of said post connecting members of one of said modular form members in proximity to said second web thereof;

one or more first insulating panels, each of said one or more first insulating panels being retained between respective first flanges of adjacent form members and respective first panel retaining members seated on respective post connecting members of adjacent spacing members; and one or more second insulating panels, each of said one or more second insulating panels being retained between respective second flanges of adjacent form members and respective second panel retaining members seated on respective post connecting members of adjacent form members.

2. The concrete form system of claim 1, wherein said rebar receiving portion comprises an elastically deformable incomplete ring, wherein a gap in said incomplete ring is less than a diameter of said vertical reinforcing bar.

3. The concrete form system of claim 1, wherein each first panel retaining member comprises a slit extending inwards from an edge thereof, the slit configured to receive an upper edge of said post connecting members.

4. The concrete form system of claim 1, wherein each second panel retaining member comprises a slit extending inwards from an edge thereof, the slit configured to receive an upper edge of said post connecting members.

5. The concrete form system of claim 3, wherein each post connecting member comprises one or more first slots formed in an upper edge thereof in proximity to said first web, wherein each said one or more slots is shaped to interlock with respective slits of said first panel retaining members.

6. The concrete form system of claim 4, wherein each post connecting member comprises one or more second slots formed in an upper edge thereof in proximity to said second web, wherein each said one or more slots is shaped to interlock with respective slits of said second panel retaining members.

* * * * *